US008516625B2

(12) United States Patent
Gardenier et al.

(10) Patent No.: US 8,516,625 B2
(45) **Date of Patent: *Aug. 27, 2013**

(54) SPA COVER

(75) Inventors: W. John Gardenier, Wallingford, CT (US); Andrew Tournas, Bethany, CT (US); Michael A. Fabiani, Wallingford, CT (US)

(73) Assignee: Hottubproducts.com, LLC, Wallingford, CT (US)

( * ) Notice: Subject to any disclaimer, the term of this patent is extended or adjusted under 35 U.S.C. 154(b) by 190 days.

This patent is subject to a terminal disclaimer.

(21) Appl. No.: 12/958,455

(22) Filed: Dec. 2, 2010

(65) Prior Publication Data

US 2012/0137423 A1 Jun. 7, 2012

(51) Int. Cl.
*E04H 4/00* (2006.01)

(52) U.S. Cl.
USPC ..... 4/498; 4/500; 4/503; 4/580; 4/557

(58) Field of Classification Search
USPC .... 4/498–503, 494, 496, 557, 580; 52/64–72
See application file for complete search history.

(56) References Cited

U.S. PATENT DOCUMENTS

| | | | | |
|---|---|---|---|---|
| 1,658,044 | A | 2/1928 | Fagan | |
| 4,040,142 | A * | 8/1977 | Ippolito | 16/251 |
| 5,086,525 | A * | 2/1992 | Christopher | 4/498 |
| 5,367,722 | A | 11/1994 | Pesterfield | |
| 5,566,403 | A | 10/1996 | Black et al. | |
| 5,644,803 | A | 7/1997 | Wilson | |
| 5,689,841 | A | 11/1997 | Black et al. | |
| 5,819,332 | A | 10/1998 | Perry | |
| 5,950,252 | A | 9/1999 | Fettes | |
| 5,974,600 | A | 11/1999 | Pucci et al. | |
| 5,996,137 | A | 12/1999 | Genova | |
| 6,000,071 | A | 12/1999 | Fettes | |
| 6,158,063 | A | 12/2000 | Tudor | |
| 6,665,890 | B1 | 12/2003 | Tedrick | |

(Continued)

FOREIGN PATENT DOCUMENTS

| | | | |
|---|---|---|---|
| AT | 004379 | U1 | 6/2001 |
| WO | WO2009/129756 | A2 | 10/2009 |

OTHER PUBLICATIONS

Adult Foam Furnishings, ZFurniture.COM, downloaded Jul. 28, 2010, available at http://www.zfurniture.com/elite-products--foam-furniture--adult-foam-furnishings.html.

Folding Beds, foamorder.com®, downloaded Jul. 28, 2010, available at http://www.foamorder.com/trifolds.html.

Fold able Foam Mattress M_(AVI), downloaded Jul. 28, 2010, available at http://www.foldingbed.net/khxc/ccp0-prodshow/m_avi.html.

(Continued)

*Primary Examiner* — Gregory Huson
*Assistant Examiner* — Erin Deery
(74) *Attorney, Agent, or Firm* — Gordon & Jacobson, PC

(57) ABSTRACT

A spa cover includes first and second portions that are rotatable along a pivot axis. The first portion has a first length traverse to the pivot axis, and the second portion has a second length extending in the same direction as the first length. The first length is longer than the second length. When the cover is moved from a closed configuration into an open configuration, lower surfaces of the first and second portions, which face the spa tub water when in the closed configuration and can become unsightly, are moved into a position in which they face each other, whereas the upper surface of the second portion faces the users in the tub. A lifter is provided for moving the spa cover between the closed and an open configurations.

21 Claims, 10 Drawing Sheets

(56) References Cited

U.S. PATENT DOCUMENTS

| | | | | |
|---|---|---|---|---|
| 6,795,984 | B1 | 9/2004 | Brady | |
| 6,842,917 | B1 * | 1/2005 | Genova | 4/498 |
| 7,055,186 | B2 | 6/2006 | Lauter et al. | |
| 7,073,213 | B2 | 7/2006 | Duarte et al. | |
| 7,281,280 | B2 | 10/2007 | Lahay | |
| 7,290,297 | B2 | 11/2007 | Cunerty | |
| 7,490,370 | B2 | 2/2009 | Macey et al. | |
| 7,721,361 | B1 * | 5/2010 | Shubert | 4/498 |
| 2003/0088912 | A1 * | 5/2003 | Lauter et al. | 4/541.1 |
| 2004/0034915 | A1 * | 2/2004 | Tedrick | 4/498 |
| 2007/0209103 | A1 | 9/2007 | Buzzetti et al. | |
| 2007/0209104 | A1 | 9/2007 | Buzzetto et al. | |
| 2008/0125195 | A1 | 5/2008 | Maenpaa | |
| 2009/0313751 | A1 | 12/2009 | Livingston | |

OTHER PUBLICATIONS

Replacement Covers, catalog description, ThermoSpas, Innovations Everything for the Spa Owner, Mar. 2, 2011.

ThermoLift 200, catalog description, ThermoSpas, Innovations Everything for the Spa Owner, Mar. 2, 2011.

ThermoLift300, catalog description, ThermoSpas, Innovations Everything for the Spa Owner, Mar. 2, 2011.

Pionier PAMAG, Whirlpool-Cover Automatic "Folder II", product description, downloaded Dec. 15, 2010, (2 pages) available at http://www.pionier.ch/content/pionier_content/02_produkte/abdeckungen/whirlpool-motorisiert/whrilpool-motorisiert.php?language=EN, Mar. 2, 2011.

Eclipse ad by Sirem, Automatic Cover for Spas, Nov. 2010.

* cited by examiner

SPA COVER

BACKGROUND OF THE INVENTION

1. Field of the Invention

This invention relates broadly to spa tubs. More particularly, this invention relates to covers for spa tubs and systems for lifting and replacing a spa tub cover relative to a portable spa tub.

2. State of the Art

Spa tubs are frequently used for relaxation, physical therapy, personal enjoyment, and for social occasions. One of the appealing attributes of a spa tubs is that the tub includes jets that direct warm pressurized water toward an interior portion of the tub. Water that exits the jets and contacts the user's skin can create a massaging effect that is pleasurable, and even rehabilitative.

Spa tubs come in two forms: permanent in-ground installations and 'portable' above-ground installations. Portable spa tubs include a frame that supports a molded tub shell, and a cabinet surrounding the frame. The tub shell has an upper boundary rim, a plurality of seating locations defined by seat bottoms and backs and reclining lounges, and a lower floor. At one or more of the seating locations hydrotherapy jets are installed and a suction fitting is provided near the floor. Between the spa shell and the cabinet a space is defined in which plumbing and manifolds are provided to connect the jets, as well as one or more water pumps that circulate the water and a heater that heats the water circulated by the water pumps.

Referring to prior art FIGS. 1-2, for purposes of energy efficiency and readiness of use, it is common to provide the spa 10 with an insulative cover 12 that limits heat loss from the water when the spa is not in use. Such a spa cover 12 includes first and second portions 14, 16 of equal size that together are sized to seat on and cover the upper rim 18 of the spa tub shell 20. Each of the first and second portions 14, 16 are constructed of insulative foam slabs provided within a water-resistant vinyl casing material. The second portion 16 is movable relative to the first portion 14 on a living hinge 22 that connects the first and second portions at their opposing inside upper corners 24, 26 so that the first portion 14 can be folded back over the second portion 16 (FIG. 2). The hinge 22 is constructed of the same vinyl material as the casing material. In order to prevent premature wear of the hinge 22 during folding, the hinge is sufficiently wide to prevent it from being subjected to excessive strain. This creates a gap 28 between the first and second portions when the cover is in the closed configuration. 'Premium' spa covers may include a spacer 30 to limit heat loss from the gap. However, such a spacer 30 does not entirely prevent heat loss at the gap. The spa cover 12 may also include a skirt 32 that further assists in preventing heat loss from around the perimeter of the spa tub.

To remove the spa cover 12, the second portion 16 is folded back onto the first portion 14. The first and second portions are then together lifted off the spa 10. Often a cover lifter 34 (FIG. 3) is provided for mechanical advantage to assist a user in lifting the cover and to temporarily hold the cover in a folded generally vertically orientation during spa use. The cover lifter seats on the cover and provides a bar which extends over the hinge and about which the second portion is folded back onto the first portion. The bar is then rotated to lift and support the cover at the hinge.

Once the spa cover 12 is lifted, it is appreciated that the upper surfaces 36, 38 of the first and second cover portions 14, 16, as designated in the flat (or closed) configuration of the cover, are now located in the middle and in contact, whereas the lower surfaces (underside water facing surfaces) 40, 42 are facing outwardly from each other. It is not uncommon for the lower surfaces 40, 42 to become discolored by fading or staining due to long-term placement over the spa tub water. As a result, when the folded cover 12 is raised for use of the spa (prior art FIG. 3), the unsightly discolored lower surface 40 of the first portion 14 faces the users in the tub 10.

In addition to heat conservation, spa covers are also important for safety reasons. Spa covers include child-locks, such as child-resistant strap locks 44, that retain the cover 12 over the spa tub 10 by engagement in latches 46 to prevent children from entering the tub when the cover is down. With the cover design shown in prior art FIG. 2, multiple locks 44 are required to hold down the cover 12; at least one lock is required for each of the first and second portions 14, 16, and more commonly two locks are provided to each such portion, particularly adjacent the corners (for a total of four locks), to prevent the respective cover portion from being lifted in a manner that would permit a child to enter under the corners of the cover and into the tub.

SUMMARY OF THE INVENTION

A spa tub cover and cover lifter for use with a portable spa tub are provided. The spa tub cover includes first and second portions that are coupled about a hinge. The first portion has a first lower surface that faces the water in the spa tub and an opposed first upper surface. The first portion includes lateral sides extending between the first upper and first lower surfaces, and which extend transverse to the first lower surface in a lengthwise dimension. The first portion also includes an inner side extending transverse to both the first lower surface and the lateral sides as well as an outer side extending parallel to and facing opposite the inner side. The inner side extends in a widthwise dimension between the lateral sides. A first length is defined as the distance between the inner side and the outer side of the first portion. A first width is defined as the distance between lateral sides of the second portion along the inner side.

The second portion of the cover includes corresponding surfaces to the first portion, with a second lower surface that faces the tub water and an opposed second upper surface. Lateral sides extend between the second lower and upper surfaces in a lengthwise dimension. An inner side extends transverse to the second lower surface in a widthwise dimension. The inner side of the second portion faces the inner side of the first portion. The second portion also includes an outer side extending between the first and second lateral sides and facing opposite the inner side of said first portion. A second length is defined as the distance between the inner side and the outer side of the second portion. A second width is defined as the distance between lateral sides of the second portion along the inner side. In accord with one aspect of the invention, the first and second widths are the same, and the first length is greater than the second length.

The first and second portions are coupled together with a hinge. The hinge extends along the first and second portions in a direction parallel to the first and second widths. The hinge is preferably a living hinge connected to the lower surfaces of the first and second portions. When the cover is in a flat (or closed) configuration, the first and second lower surfaces are co-planar and seat adjacent one another on an upper rim of a spa tub. When the cover is moved into a folded (or open) configuration, the lower surfaces which face the water when in the closed configuration and can be unsightly, are moved into a position in which they face each other, whereas the upper surface of the second portion faces the users in the tub.

Given that the first and second sides have different lengths, when the cover is in the open configuration, the first and second outer sides are longitudinally displaced from one another such that they are not coplanar.

The first portion of the cover includes a plurality of sleeves and/or pockets at which the lifter can be coupled. The lifter facilitates lifting the cover from the closed configuration to the open configuration. The lifter includes a mount positionable relative to the spa tub. The mount may be fixed to the frame and/or cabinet of the spa tub, or may be provided on a stable support adjacent the spa tub. A first support element of the lifter is rotatable about a pivot axis and is connected to the first upper surface of the first portion. In accord with another aspect of the invention, a second support element extends from the mount and adjacent the outer surface of the first portion so that when the cover is rotated into the open configuration, the weight of the spa cover is at least partially supported directly on the second support.

According to another aspects of the invention, a shield is coupled to the first upper surface of the first portion and movable relative to the second upper surface of the second portion. As such, when the cover is moved into the open configuration, the opening between the first and second inner surfaces remains covered by the shield. This prevents environmental debris, such as leaves, from falling into the hinge during use.

Because the upper surface of the second portion faces the users of the spa tub when the cover is in the open position, according to another aspect of the invention at least one audio and/or video device is disposed at least partially within the upper surface of the second portion. Such a device can include a television, video or computer monitor, amplifier, speakers, etc. The cover may include flaps or other structure which cover such device when not in use.

According to yet another aspect of the invention, given the manner in which the cover moves toward an open configuration, the cover lifter can be configured to orient the first portion of the cover transverse to the upper rim of the spa tub, and suspend the second portion of the cover over the spa tub; i.e., the second lower surface is preferably substantially parallel to, but vertically displaced from the upper rim. This allows the second portion of the spa cover to function as a sun shade. Further, a supplemental shade may be integrated into or coupled to the second portion of the cover such that it may extend therefrom to provide additional shade over the spa tub.

Additional objects and advantages of the invention will become apparent to those skilled in the art upon reference to the detailed description taken in conjunction with the provided figures.

BRIEF DESCRIPTION OF THE DRAWINGS

Prior art

Prior art

Prior art

DETAILED DESCRIPTION OF THE PREFERRED EMBODIMENTS

Figure 1:
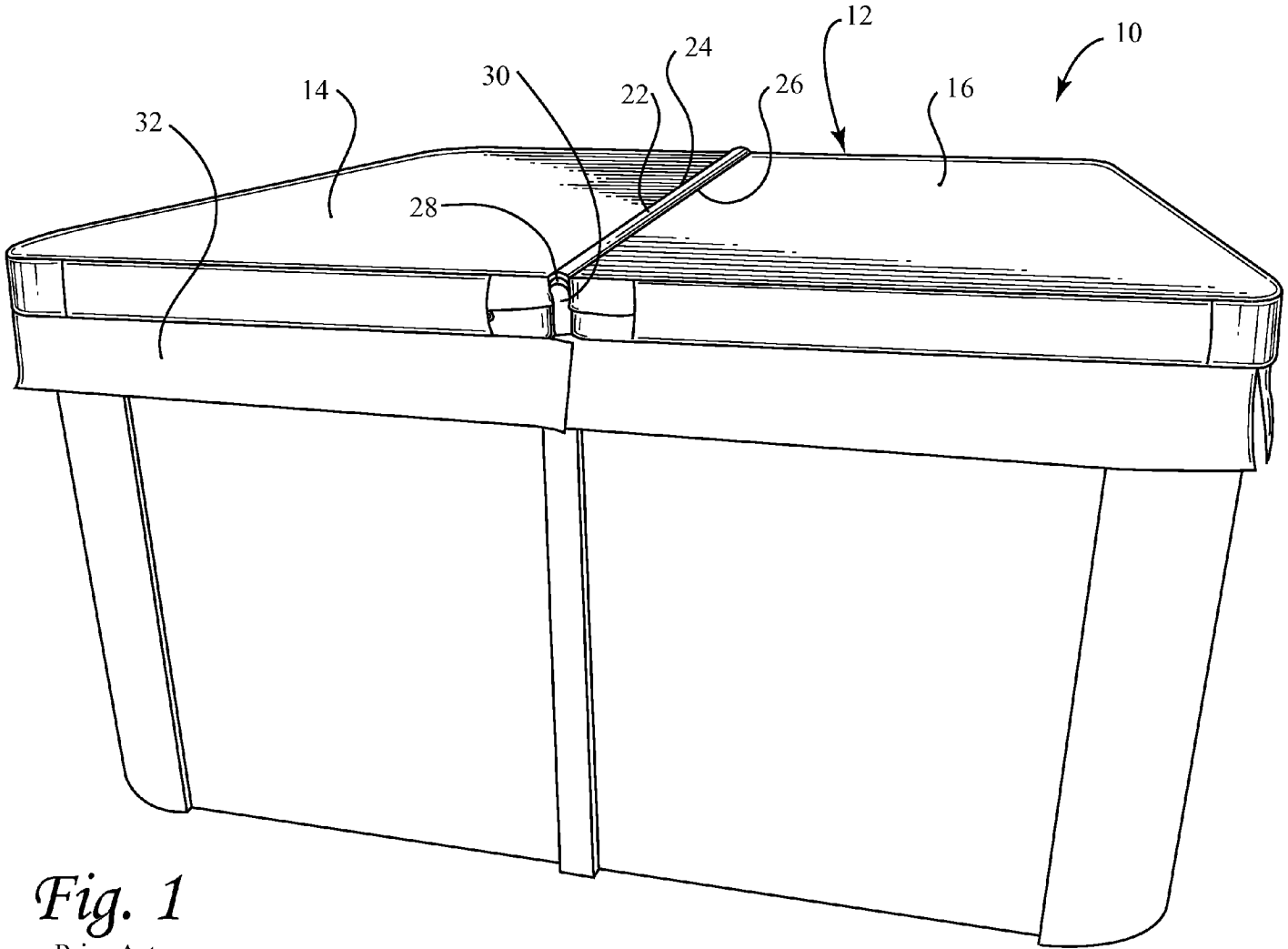
Fig. 1 Prior Art
FIG. 1 is a perspective view of a spa tub provided with a prior art insulative cover.
Figure 2:
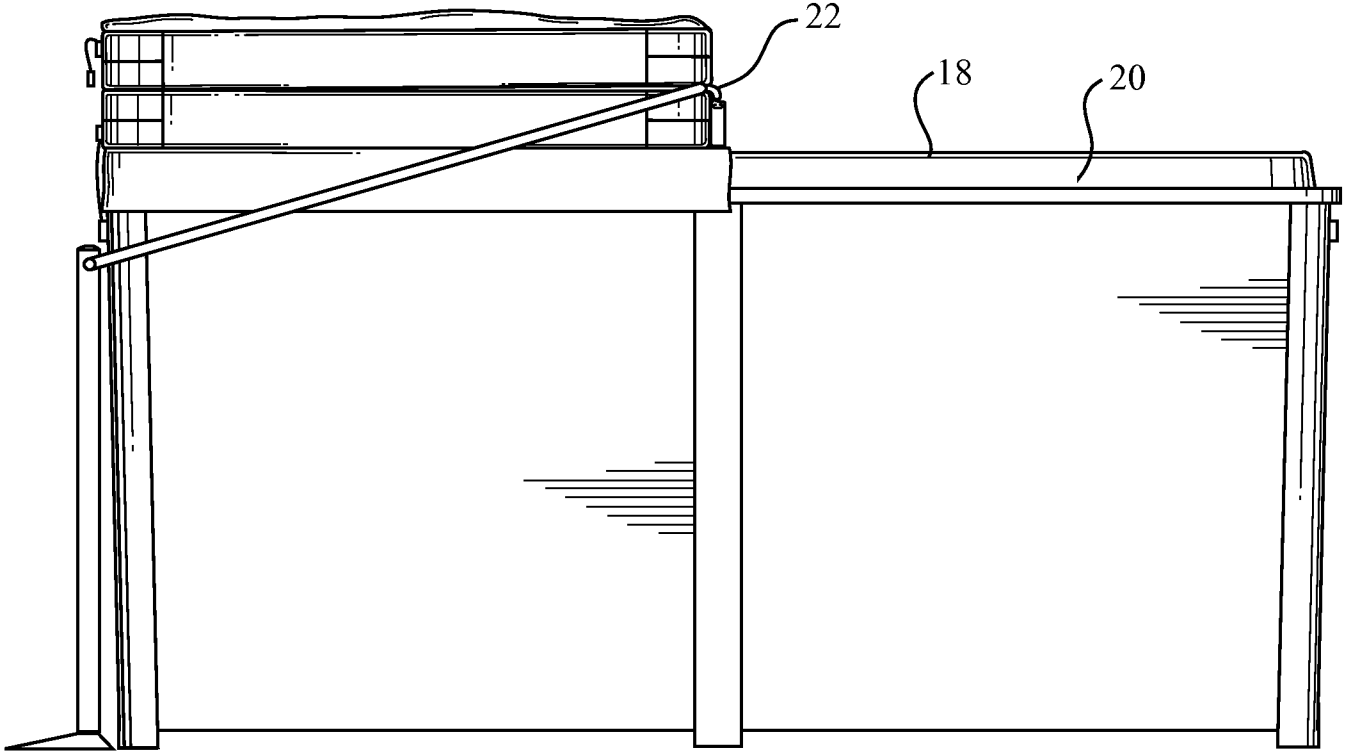
Fig. 2 Prior Art
FIG. 2 is a side view of the spa tub and cover of FIG. 1, in which the cover is in a partially open configuration.
Figure 3:
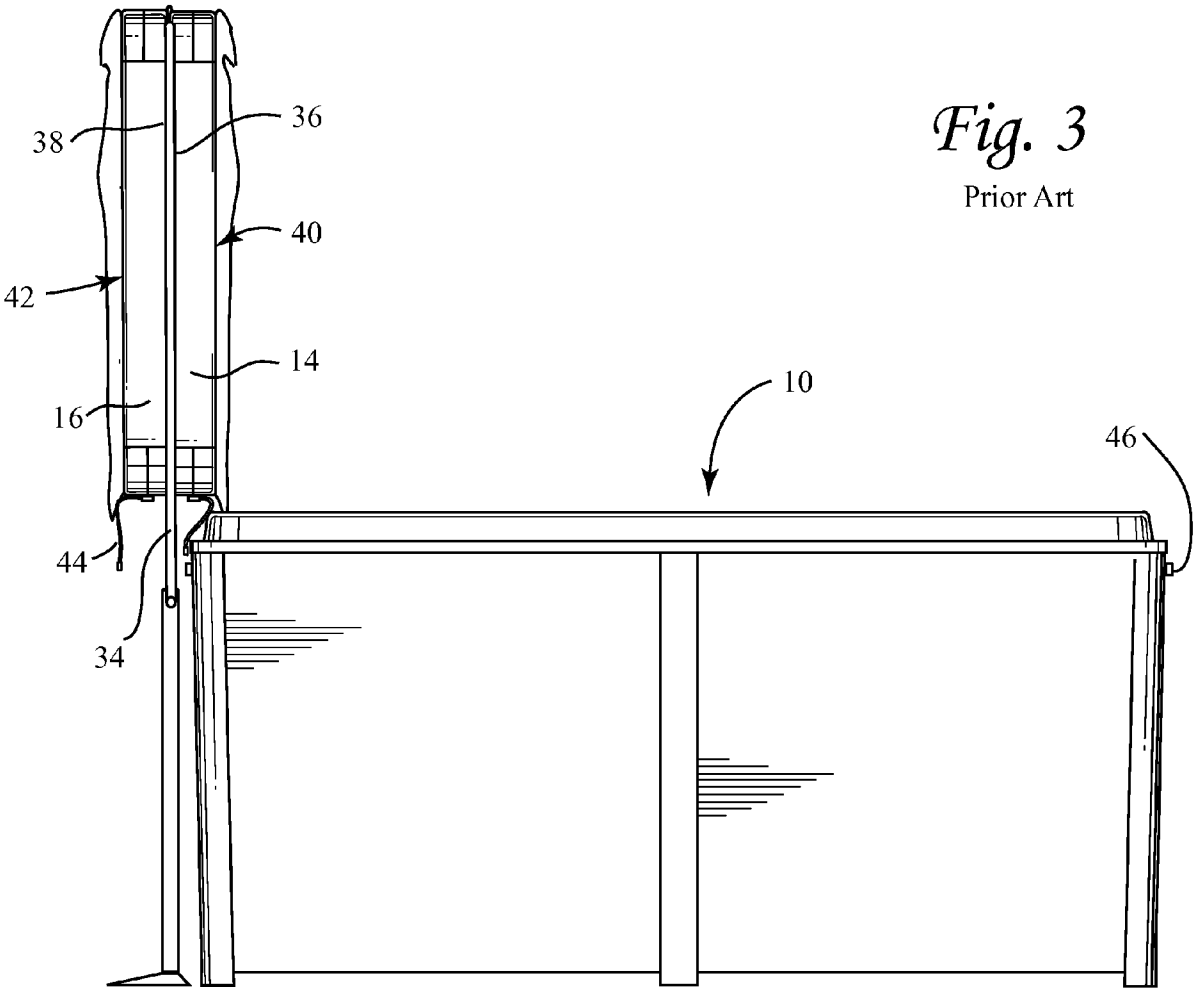
Fig. 3 Prior Art
FIG. 3 is a side view of the spa tub and cover of FIG. 1, in which the cover is in a fully open configuration.
Figure 4:
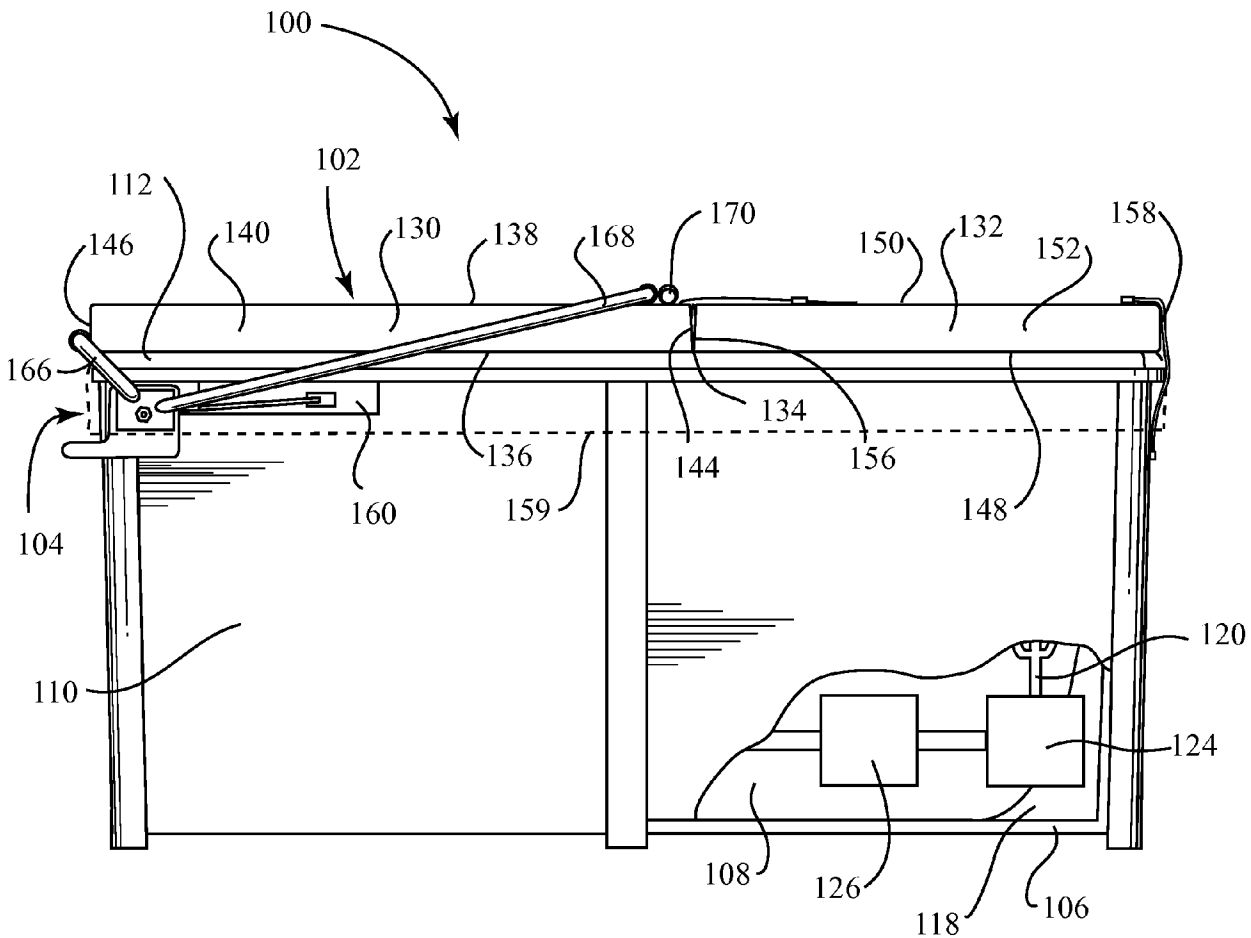
FIG. 4 is a partial side elevation of a spa tub and cover with cover lifter according to the invention.
Figure 5:
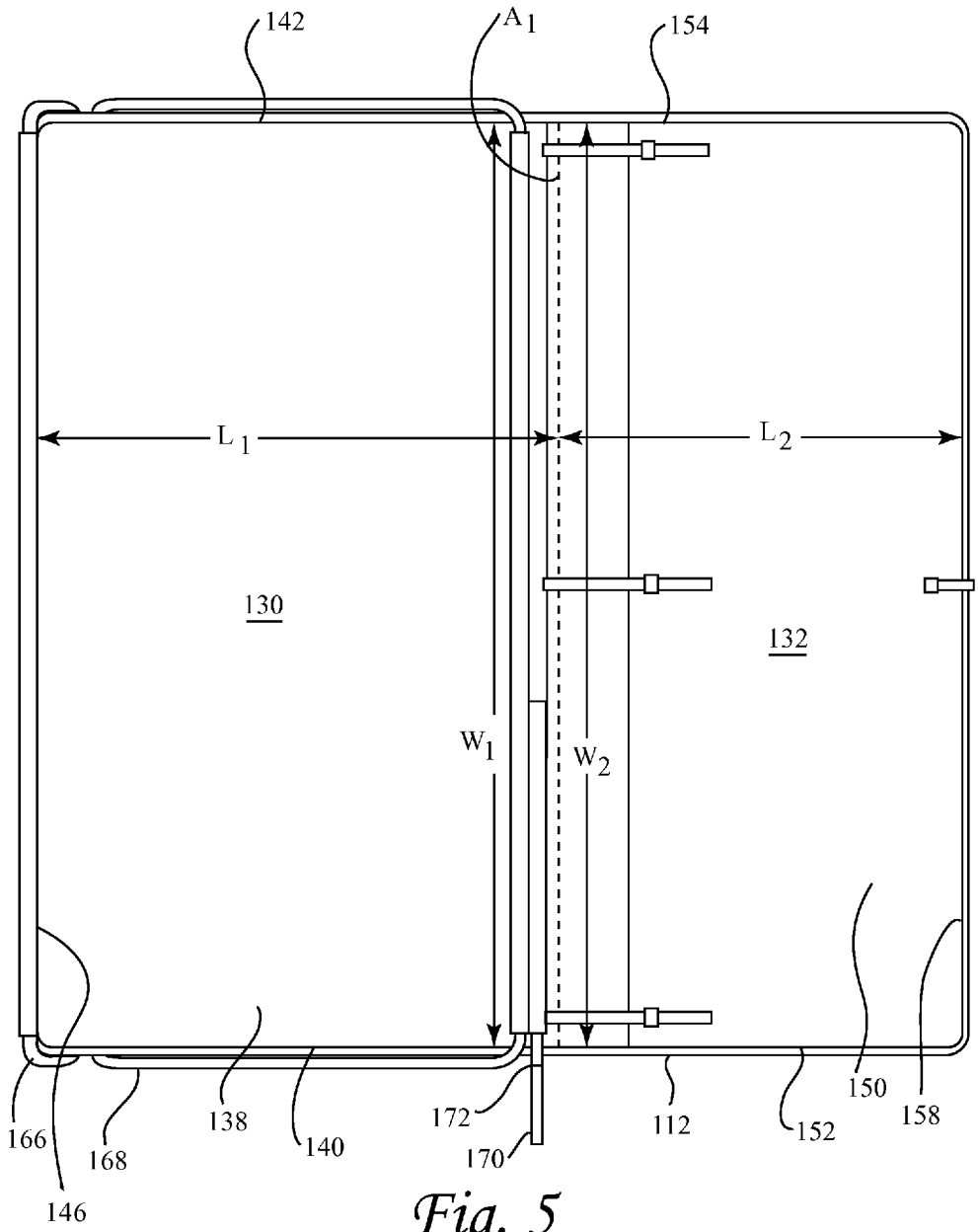
FIG. 5 is a top view of the spa tub cover and lifter of FIG. 4.
Figure 6:
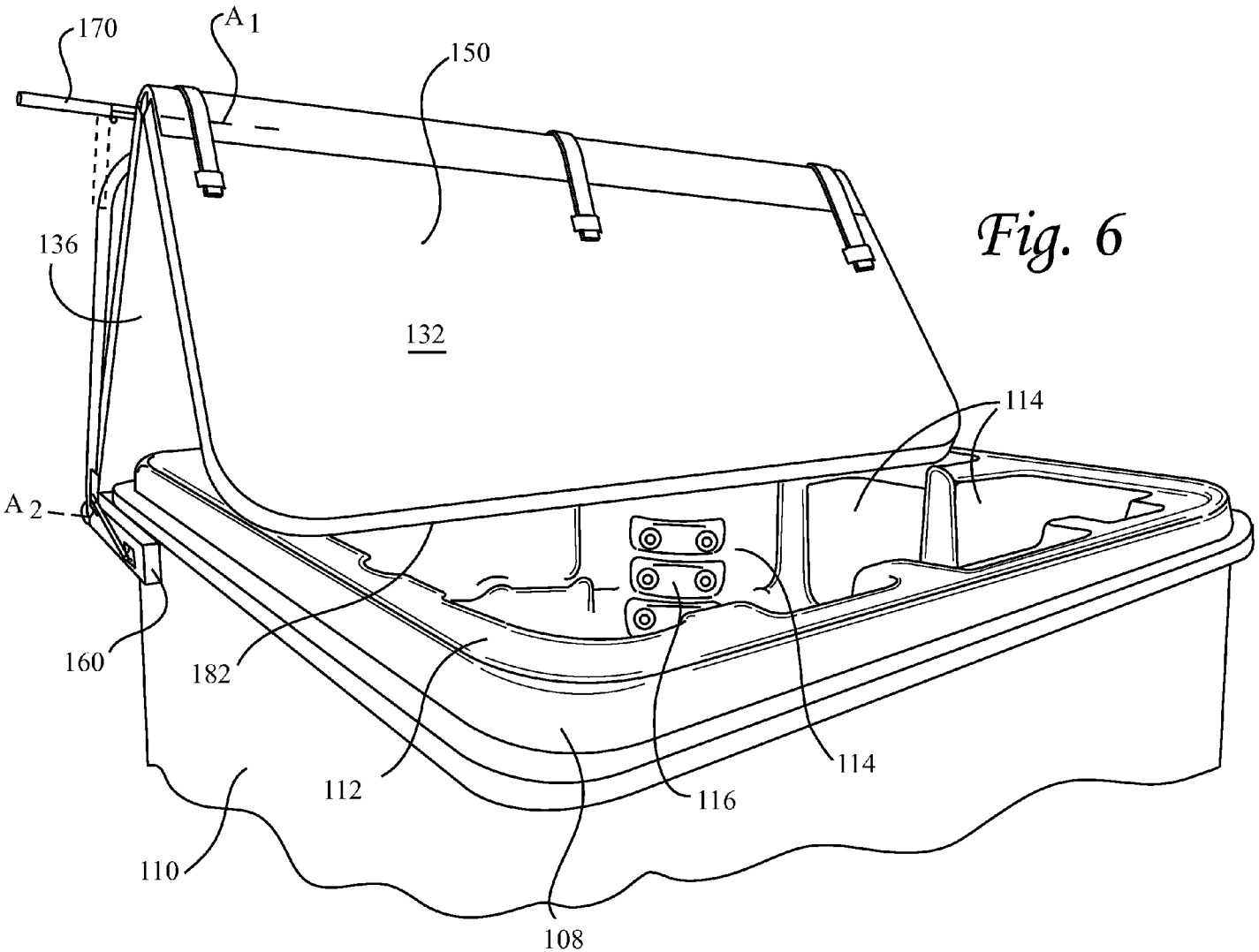
FIG. 6 is a perspective view of the spa tub, cover and lifter, with the cover and lifter shown in a partially open configuration.

Turning now to FIG. 4-6, a portable spa tub 100 is provided with a spa tub cover 102 and a lifter 104 for raising the tub cover relative to the tub so that the tub may be used. The portable spa tub 100 includes a frame 106 that supports a molded tub shell 108, and a cabinet 110 surrounding the frame. The tub shell 108 has an upper boundary rim 112, a plurality of seating locations 114 defined by seat bottoms and backs and reclining lounges, and a lower floor. At one or more of the seating locations 114 hydrotherapy jets 116 are installed and a suction fitting (not shown) is provided near the floor. Between the spa shell 108 and the cabinet 110 a space 118 is defined in which manifolds and other plumbing 120 are provided to connect the jets, as well as one or more water pumps 124 that circulate the water and a heater 126 that heats the water circulated by the water pumps.

The spa cover 102 includes first and second rectangular portions 130, 132 which together are sized to seat on and cover the upper rim 112 of the spa tub shell 108. The first and second portions 130, 132 are coupled together at a hinge 134, as described in more detail below. Each of the first and second portions 130, 132 is constructed of an insulative slab (e.g., a foam slab that has low transmission of heat energy, especially with respect to water heated to a temperature of between 75° and 110°) provided within an at least water-resistant, and more preferably waterproof, casing material such as vinyl.

The first portion 130 of the spa cover has a first lower surface 136 that faces the water in the spa tub 100 and an opposed first upper surface 138. Lateral sides 140, 142 extend between the first lower and first upper surfaces 136, 138. The lateral sides 140, 142 also extend transverse to the first lower surface 136 in a lengthwise dimension. The first portion 130 also includes an inner side 144 extending transverse to both the first lower surface 136 and the lateral sides 140, 142, as well as an outer side 146 extending parallel to and facing opposite the inner side 144. The inner side 144 extends in a widthwise dimension between the lateral sides 140, 142. A first length L1 is defined as the distance between the inner side 144 and the outer side 146. A first width W1 is defined as the distance between lateral sides 140, 142 along the inner side 144.

The second portion 132 of the cover includes corresponding surfaces to the first portion 130, with a second lower surface 148 that faces the tub water and an opposed second upper surface 150. Lateral sides 152, 154 extend between the second lower and upper surfaces 148, 150 in a lengthwise dimension. An inner side 156 extends transverse to the second lower surface 148 in a widthwise dimension between the lateral sides 152, 154. The inner side 156 of the second portion faces the inner side 144 of the first portion. The second portion 132 also includes an outer side 158 extending between the first and second lateral sides 152, 154 and facing opposite the inner side 144 of said first portion. A second length L2 is defined as the distance between the inner side 156 and the outer side 158. A second width W2 is defined as the distance between lateral sides along the inner side 156. In accord with one aspect of the invention, the first and second widths W1, W2 are the same, and the first length L1 is greater than the second length L2. The reasons that length L1 is greater than length L2 is described below.

Figure 7:
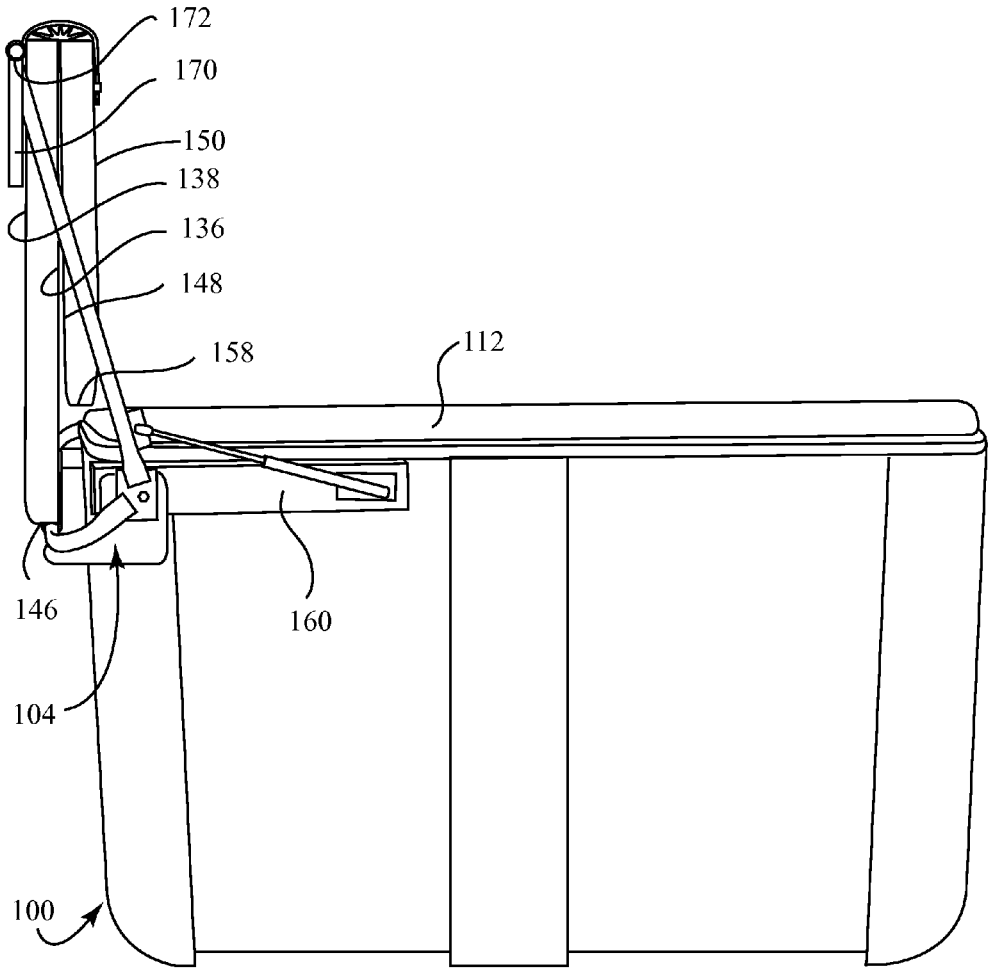
FIG. 7 is a side elevation view of the spa tub, cover and lifter, with the cover and lifter shown in a fully open configuration.
Figure 8:
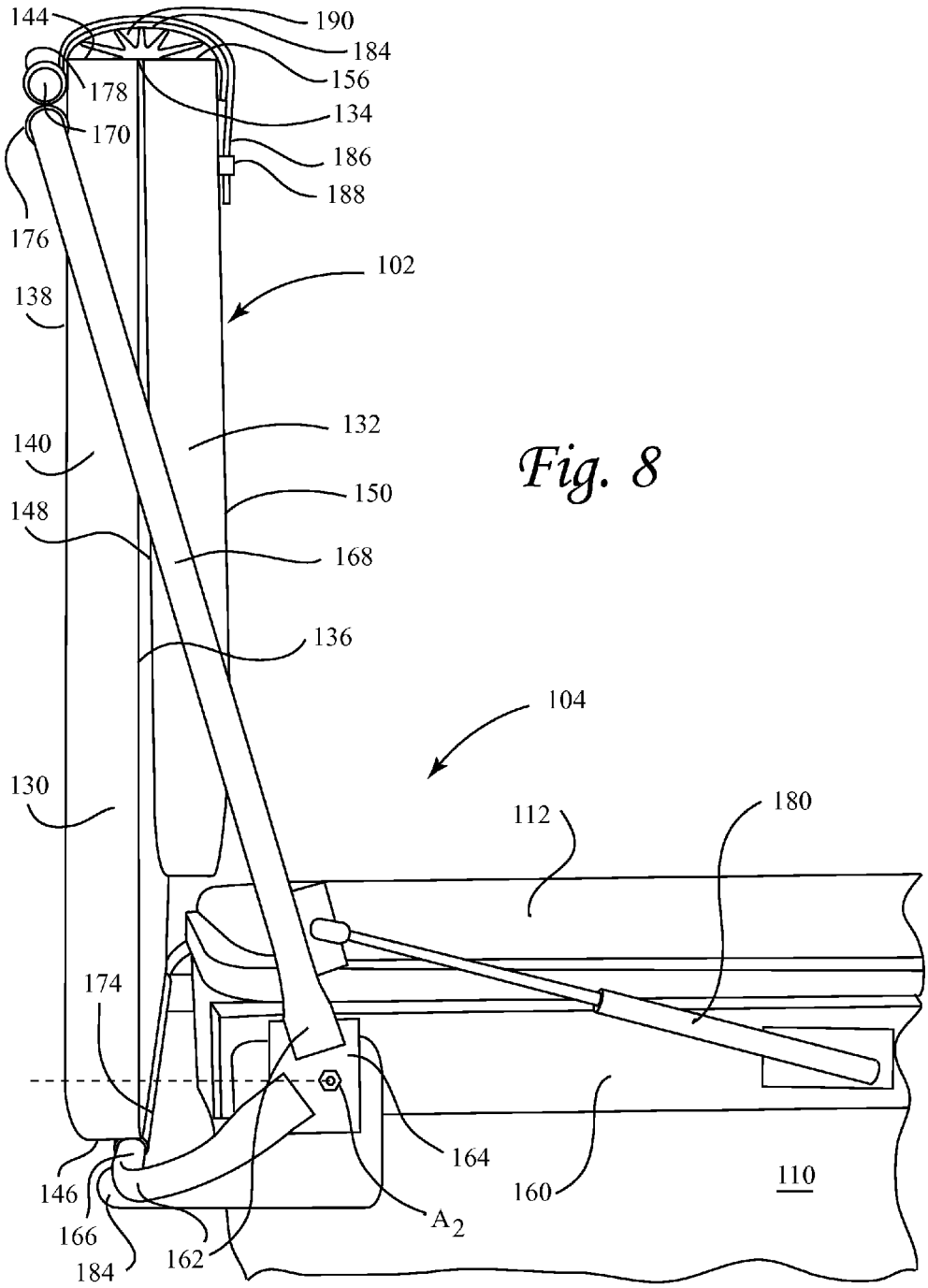
FIG. 8 is an enlarged broken view of a portion of the spa tub, cover and lifter shown in the configuration of FIG. 7.

The hinge 134 that couples the first and second portions 130, 132 has a pivot axis A1 that extends along the first and second portions in a direction parallel to the widthwise dimension defining W1 and W2. The hinge 134 is preferably a living hinge connected to the lower surfaces 136, 148 of the first and second portions. When the cover 102 is in a flat 'closed' configuration, the first and second lower surfaces 136, 148 are co-planar and seat adjacent one another on the upper rim 112 of the spa tub. Because the hinge is preferably provided as a living hinge of the same vinyl material of the first and second portions and because the hinge is provided at the lower surface, an unbroken seal is provided about the entirety of the rim, without the space for heat loss that results from prior art covers. Optionally, a flexible skirt 159 also extends about the perimeters of the first and second lower surfaces to further reduce the opportunity for heat loss. However, given that the hinge is at the lower surface, the methods of opening and removing a spa cover which are used in the prior art cannot be used with the cover of the invention, and another method is provided as described hereinafter. Referring to FIGS. 7 and 8, when the cover 102 is moved into a folded 'open' configuration, the lower surfaces 136, 148 which face the water when in the closed configuration and can be unsightly, are moved into a position in which they face each other, whereas the upper surface 150 of the second portion faces the users in the tub 100 and opposite upper surface 136. The lengths L1 and L2 are different to allow the spa cover to be folded and raised up; given the manner of folding and raising, if the lengths L1, L2 were equal the second portion 132 would be too long to rotate into a vertical position with the relatively small profile lifter and about a pivot axis located on the spa cabinet. Given that the first and second portions 130, 132 have different lengths L1, L2 (maximum dimension transverse to the hinge pivot axis A1), when the cover 102 is in the open configuration, the first and second outer sides 146, 158 are longitudinally displaced from one another such that they are not coplanar.

The lifter 104 facilitates lifting the cover 102 from the closed configuration (FIGS. 4 and 5) to the open configuration (FIGS. 7 and 8). Referring specifically to FIG. 8, the lifter 104 is coupled to the spa tub with one or more supports 160 that are attached directly to the spa tub 100, such as at the frame and cabinet 110 as shown, or may be self-supporting on the ground (not shown). In the embodiment of the lifter 104 shown in the figures, two supports are provided on opposite sides of the spa tub, but only one support 160 is visible. It is appreciated that the second support is a mirror image of the first support. A lifter frame 162 is coupled to the supports 160 at mounts 164 rotatable about a common pivot axis A2. The lifter frame 162 includes a U-shaped outer member 166 which extends across the outer side 146 of the first portion 130 and to the mounts 164, and a U-shaped upper member 168 that extends along the lateral sides 140, 142 of the first portion at an oblique angle relative to the lower surface 136 and across the upper surface 138 of the first portion in proximity to the inner side 144 (FIG. 4). The lifter frame 162 also includes a handle member 170 that extends or is extendable laterally outward from the spa tub 100 to facilitate movement thereof and may be integrated with or distinct from the upper member 168. The handle 170 may be connected to or integrated with the upper member 168, fixed in position relative to the upper member 168, or may movable relative to the upper member so that the handle does not protrude relative to the sides of the spa tub 100 when not in use. By way of example, the handle 170 may be coupled to a hinge 172 that permits it to fold relative to the frame (FIGS. 6 and 7) or may telescope into a recessed position.

Referring to FIG. 8, in order to couple the lifter 104 to the first portion 130 of the spa cover 102, the first portion 130 of the cover includes a plurality of sleeves, loops, pockets, ties, hook and loop straps, or other suitable structure at which the lifter can be coupled. For example, a first sleeve 174 is provided at the outer side 146 of the first portion and receives the outer member 166 of the frame, a second sleeve 176 is provided along the upper surface 138 and receives the upper member 168 of the frame, and a third sleeve 178 is provided adjacent the second sleeve 176 and receives the handle 170.

A pneumatic cylinder 180, piston, spring (e.g., metal or gas), or other form of lift assist, preferably extends between each support 160 and the upper member 168 of the frame to limit the amount of human effort required to lift the cover. In addition, the cylinders 180 assist in smoothly rotating the spa cover into the closed position and also prevents the spa cover from rotating too quickly from the open position to the closed position due to, e.g., a lack of sufficient strength to control such smooth closure or slippage of the handle from one's grip.

Referring to FIGS. 6 and 8, when the handle 170 is raised, the lifter is rotated about axis A2. This causes the second portion 132 to rotate about hinge axis A1 (with the corner 182 defined between the lower surface 148 and the outer side 158 being drawn across and in contact with the rim 112) toward the open configuration. As the lifter rotates, the weight of the spa cover is transferred to the outer member 166 which at least partially supports the weight of the first and second portions 130, 132. Once the lifter 104 is fully rotated about axis A2, e.g., through approximately 90° of rotation, the second portion 132 is raised off the rim 112. A stop 184, either integrated with the support 160 or distinct therefrom, limits the range of rotation of the lifter and assists in supporting the weight of the lifted cover.

In accord with a preferred aspect of the invention, when in the open configuration the first portion 130 is situated with its outer side 146 below the surface of the rim 112 of the tub and is situated vertically below the pivot axis A2, while the second portion 132 is preferably situated with its outer side 158 vertically even with or above the rim. As stated above, in this open configuration, the lower surfaces 136, 148 face one another, and the upper surfaces 138, 150 face opposite one another. The upper surface 150 of the second portion is oriented in a substantially vertical plane and faces toward the spa tub 100.

A debris shield 184 is provided over the hinge 134 to protect the hinge from acquiring environmental detritus, such as leaves, cut grass, insects, etc., particularly when the cover 102 is in the open configuration and the inner sides 144, 156 of the first and second portions are rotated apart. That is, because the hinge 134 is located along the lower surfaces 136, 148, the cover at the hinge is open at top. The debris shield 184 is a preferably flexible panel that extends over the cover 102 at the hinge 134 and is preferably fixed with respect to one of the first and second portions 130, 132, and preferably movable relative to the other of the first and second portions 132, 130. In a preferred embodiment, the debris shield 184 is fixed to the upper surface 138 of the first portion 130, preferably proximate the hinge 134 opening, and extends across the hinge opening to rest on the upper surface 150 of the second portion 132. The shield 184 may be fixed to the first portion 130 by sewing, adhesive bonding or any other suitable means. The shield 184 is movably retained along the upper surface 150 of the second portion 132. For example, receiving straps 186 extending from the panel may slidably move within strap loops 188 along the upper surface of the second portion. In the closed configuration, the straps 186 extend more completely through the loops 188, whereas as the cover is moved toward the open configuration, the straps 186 are drawn through the loops 188, preferably without becoming free thereof, to permit the hinge to open. Alternatively, the debris shield 184 may be fixed to both the first and second portions 130, 132, and constructed of an elastic and/or resilient material that permits the shield to stretch as the cover is moved into the open configuration. The debris shield 184 preferably further includes a bias member 190 that biases the shield into a convex configuration when the cover is in the open configuration so that shield does not fall between the first and second cover portions 130, 132 and to present a surface that deflects debris. The bias member 190 may include a plicated structure that folds flat as the spa cover is moved into a closed configuration, but which expands and bows outward as the cover is moved into the open configuration. Alternative or additional bias members may be used.

Figure 9:
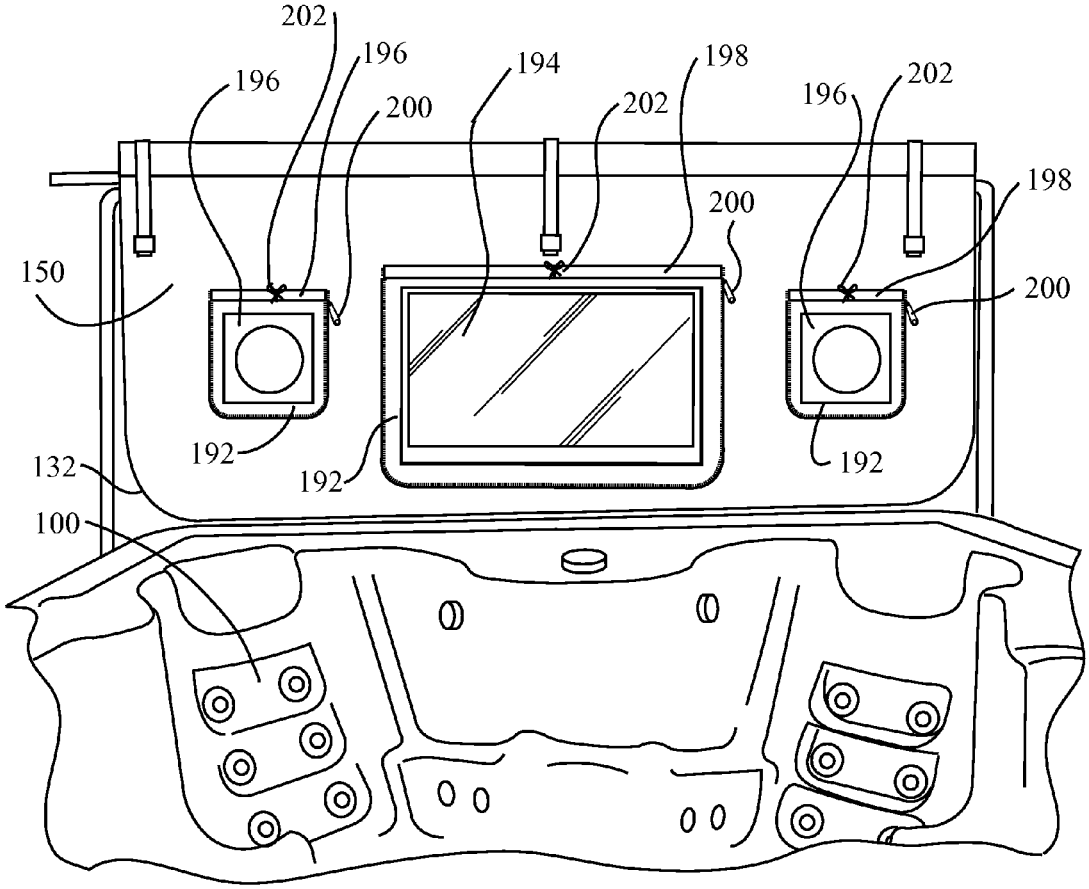
FIG. 9 is a broken end view of the spa tub, cover and lifter shown in the open configuration, with optional audio and video components installed in the cover.

Turning now to FIG. 9, as discussed above, when the spa tub cover 102 is in the open configuration, the upper surface 150 of the second portion 132 faces the users of the spa tub 100. According to another preferred aspect of the invention, at least one audio and/or video device is at least partially disposed within one or more openings 192 in the upper surface of the second portion. Such a device can include a video monitor 194, which may include a television tuner or inputs for receiving a signal from any suitable source such as a computer, as well as speakers 196, an amplifier, etc. The upper surface 150 of the second portion 132 is preferably provided with flaps 198 or other structure which cover the video monitor and speakers when not in use. Such flaps 198 may be retained closed with a zipper 200, hook and loop fasteners or any other suitable means so that environmental debris does not effect the devices, particularly when the cover is closed and the spa tub is not in use. In addition, retaining ties 202 may be provided to hold the flaps 198 open so that they do not obstruct the audio and/or video devices during use.

Figure 10:
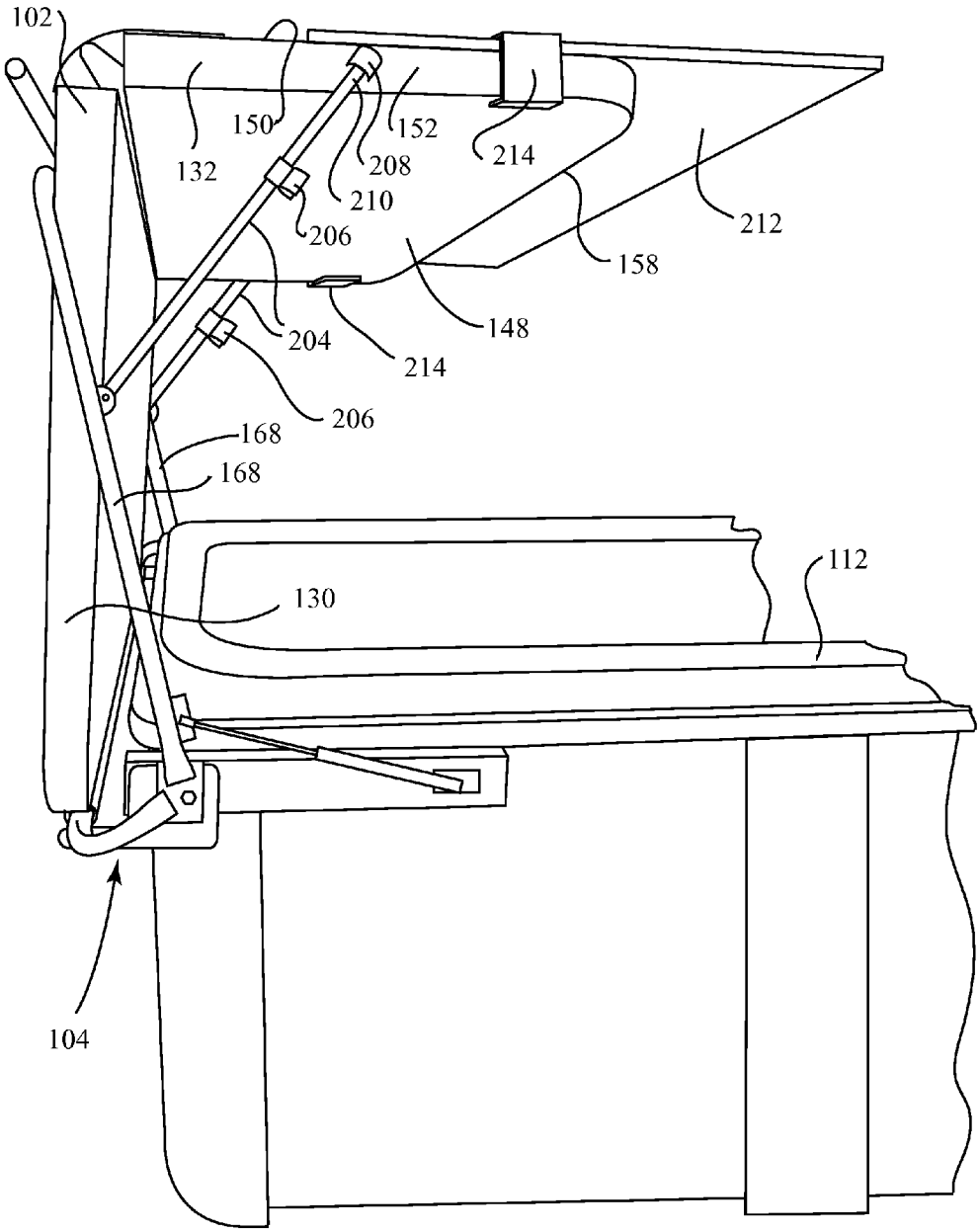
FIG. 10 is a broken side elevation of the spa tub, cover and lifter shown in a configuration in which a portion of the cover is oriented to provide shade.

Referring to FIG. 10, according to yet another preferred aspect of the invention, given the manner in which the cover 102 moves toward an open configuration, the cover lifter 104 can be configured to orient the first portion 130 of the cover transverse to the upper rim 112 of the spa tub, and suspend the second portion 132 of the cover over the spa tub; i.e., the second lower surface 148 is preferably substantially parallel to (within)±20°, but vertically displaced from the upper rim 112. Additional frame members, such as struts 204, may be provided to temporarily lock the frame with first and second portions in this position. Struts may be pivotally mounted to upper member 168 and may each be provided with a latch 206 that couples the strut to the upper member when not in use. The second portion 132 of the cover preferably includes pockets 208 at the lateral sides 152, 154 in which the free ends 210 of the struts 204 may be received to couple the struts to the second portion of the cover. This allows the second portion 132 of the spa cover, extending and retained over a portion of the spa tub and the users therein, to function as a sun shade. Further, a supplemental shade 212 may be integrated into or coupled to the second portion of the cover such that it may extend therefrom to provide additional shade over the spa tub and the users. Such supplemental shade 212 may be attached to the second portion with releasable brackets 214, may be slidable along the upper surface 150 of the second portion 132, or may be foldable outward, telescope outward, or drawn and retained outward relative to the outer side 158 of the second portion.

There have been described and illustrated herein several embodiments of a spa cover, a lifter in association of the spa cover, and a spa provided with the cover and lifter. In addition, methods of folding the spa cover are also provided. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A spa tub cover for a portable spa tub that contains water, said spa tub cover for use with a cover lifter having a frame, said cover comprising:

a) a first portion including a heat insulative interior surrounded by an at least water resistant covering, said first portion having a first lower surface that faces water in the spa tub, an opposed first upper surface, a first inner surface, and a first outer surface, said first lower surface defining a first width and a first length transverse to said first width;

b) a second portion including a heat insulative interior surrounded by an at least water resistant covering, said second portion having a second lower surface that faces the water, an opposed second upper surface, a second inner surface, and a second outer surface opposite said second inner surface, said second lower surface defining a second width and a second length transverse to said second width;

c) a hinge at said lower surfaces of said first and second portions, said hinge having a hinge axis extending parallel to said first and second widths, said first and second portions movable about said hinge axis, wherein said first and second widths are the same, said first length is greater than said second length, and said spa tub cover having a flat configuration in which said first and second lower surfaces are co-planar and said first and second inner surfaces face on another, and a folded configuration in which said first and second inner surfaces are rotated about said hinge and said first and second lower surfaces face one another; and d) a debris shield provided at the first and second upper surfaces to cover said hinge when said first and second portions are in said folded configuration.

2. A spa tub cover according to claim 1, wherein:

said debris shield is fixed to one of said first and second portions and movable relative to the other of said first and second portions.

3. A spa tub cover according to claim 2, wherein:

said debris shield includes straps, said second portion includes loops along said second upper surface, and said straps are movable within said loops when said cover is moved from said flat to said folded configuration.

4. A spa tub cover according to claim 1, further comprising:

an element that prevents said shield from entering between said inner surfaces of said first and second portions.

5. A spa tub cover according to claim 4, wherein:

said element is biased outward when said cover in said folded configuration, and collapses between said first and second inner surfaces when said cover in said flat configuration.

6. A spa tub cover according to claim 5, wherein:
said element is plicated.

7. A spa tub cover according to claim 1, further comprising:
means for attaching said cover to the frame of the cover lifter.

8. A spa tub cover according to claim 7, wherein:
said means for attaching includes means for attaching said upper and outer surfaces of said first portion to the frame.

9. A spa tub cover according to claim 1, further comprising:
at least one of audio and video equipment disposed at least partially within said upper surface of said second portion.

10. A spa tub cover according to claim 1, further comprising:
a sun shade that is extendable relative to said outer side of said second portion.

11. A spa tub cover according to claim 1, further comprising:
a skirt extending about a periphery of said first and second lower surfaces.

12. A spa tub cover for a portable spa tub that contains water for use in association with a cover lifter having first and second support elements for supporting the cover, said spa tub cover comprising:

a) a first portion including a heat insulative interior surrounded by an at least water resistant covering, said first portion having a first lower surface that faces water in the spa tub, an opposed first upper surface, said first lower surface defining a first width and a first length transverse to said first width, said first portion further having first and second lateral sides extending in a lengthwise dimension, a first inner side extending in a widthwise dimension between said first and second lateral sides, and a second outer side extending in said widthwise dimension between said first and second lateral sides and facing opposite said first inner side,
wherein said upper surface of said first portion includes a first means for coupling to the first support element of the cover lifter, and said outer side of said first portion includes a second means for coupling to the second support element of the cover lifter;

b) a second portion including a heat insulative interior surrounded by an at least water resistant covering, said second portion having a second lower surface that faces the water, an opposed second upper surface, said second lower surface defining a second width and a second length transverse to said second width, said second portion further having first and second lateral sides extending in said lengthwise dimension, a second inner side extending in said widthwise dimension between said first and second lateral sides, and a second outer side extending in said widthwise dimension between said first and second lateral sides; and c) a hinge connecting said first and second lower surfaces of said first and second portions and defining a hinge axis parallel to said first and second widths about which said first and second portions are movable relative to each other, wherein
said first and second widths are the same,
said first length is greater than said second length, and
said spa tub cover having a flat configuration in which said first and second lower surfaces are co-planar and said first and second inner surfaces face on another, and a folded configuration in which said first and second inner surfaces are rotated about said hinge axis and said first and second lower surfaces face one another.

13. A spa tub cover according to claim 12, wherein:
said first means for coupling is a sleeve.

14. A spa tub cover according to claim 12, wherein:
said second means for coupling is a sleeve.

15. A spa tub cover according to claim 12, further comprising:
at least one of audio and video equipment disposed at least partially within said upper surface of said second portion.

16. A spa tub cover according to claim 12, further comprising:
a sun shade that is extendable relative to said outer side of said second portion.

17. A spa tub cover for a portable spa tub that contains water for use in association with a cover lifter having at least one support element for supporting the cover, said spa tub cover comprising:

a) a first portion including a heat insulative interior surrounded by an at least water resistant covering, said first portion having a first lower surface that faces water in the spa tub, an opposed first upper surface, said first lower surface defining a first width and a first length transverse to said first width, said first portion further having first and second lateral sides extending in a lengthwise dimension, a first inner side extending in a widthwise dimension between said first and second lateral sides, and a second outer side extending in said widthwise dimension between said first and second lateral sides and facing opposite said first inner side;

b) a second portion including a heat insulative interior surrounded by an at least water resistant covering, said second portion having a second lower surface that faces the water, an opposed second upper surface, said second lower surface defining a second width and a second length transverse to said second width, said second portion further having first and second lateral sides extending in said lengthwise dimension, a second inner side extending in said widthwise dimension between said first and second lateral sides, and a second outer side extending in said widthwise dimension between said first and second lateral sides;

c) at least one of audio and video equipment disposed at least partially within said upper surface of said second portion; and d) a hinge connecting said first and second portions such that a hinge axis extends parallel to said first and second widths, said first and second portions movable about said hinge axis, wherein
said first and second widths are the same,
said first length is greater than said second length, and
said spa tub cover having a flat configuration in which said first and second lower surfaces are co-planar and said first and second inner surfaces face on another, and a folded configuration in which said first and second inner surfaces are rotated about said hinge axis and said first and second lower surfaces face one another.

18. A spa tub cover for a portable spa tub that contains water for use in association with a cover lifter having at least one support element for supporting the cover, said spa tub cover comprising:

a) a first portion including a heat insulative interior surrounded by an at least water resistant covering, said first portion having a first lower surface that faces water in the spa tub, an opposed first upper surface, said first lower surface defining a first width and a first length transverse to said first width, said first portion further having first and second lateral sides extending in a lengthwise dimension, a first inner side extending in a widthwise dimension between said first and second lateral sides, and a second outer side extending in said widthwise dimension between said first and second lateral sides and facing opposite said first inner side;

b) a second portion including a heat insulative interior surrounded by an at least water resistant covering, said second portion having a second lower surface that faces the water, an opposed second upper surface, said second lower surface defining a second width and a second length transverse to said second width, said second portion further having first and second lateral sides extending in said lengthwise dimension, a second inner side extending in said widthwise dimension between said first and second lateral sides, and a second outer side extending in said widthwise dimension between said first and second lateral sides, c) a hinge connecting said first and second lower surfaces of said first and second portions and defining a hinge axis parallel to said first and second widths about which said first and second portions are movable relative to each other, wherein said first and second widths are the same, said first length is greater than said second length, and said spa tub cover having a flat configuration in which said first and second lower surfaces are co-planar and said first and second inner surfaces face on another, and a folded configuration in which said first and second inner surfaces are rotated about said hinge axis and said first and second lower surfaces face one another and are in an upright orientation; and d) a support, wherein said second portion can be rotated upward about said hinge from said upright orientation into a raised position while said first portion remains in said upright orientation, wherein when said second portion is in said raised position said second lower surface is vertically displaced and faces the spa tub, said support retaining said second portion in said raised position.

19. A spa tub cover according to claim 18, wherein:

a sun shade attached to said second portion in said raised position.

20. A spa tub cover according to claim 1, wherein:

said debris shield has a first side on a first side of said hinge that is fixed to one of said first and second portions and a second side on an opposite side of said hinge that is displaceable relative to the other of said first and second portions.

21. A spa tub cover according to claim 20, wherein:

said second side is slidably displaceable relative to the other of said first and second portions.

* * * * *